US008662819B2

(12) United States Patent
Beaulieu

(10) Patent No.: US 8,662,819 B2
(45) Date of Patent: Mar. 4, 2014

(54) APPARATUS AND METHOD FOR PREVENTING CRACKING OF TURBINE ENGINE CASES

(75) Inventor: Gilford Beaulieu, Vernon, CT (US)

(73) Assignee: United Technologies Corporation, Hartford, CT (US)

( * ) Notice: Subject to any disclaimer, the term of this patent is extended or adjusted under 35 U.S.C. 154(b) by 1350 days.

(21) Appl. No.: 12/635,131

(22) Filed: Dec. 10, 2009

(65) Prior Publication Data

US 2010/0196149 A1 Aug. 5, 2010

Related U.S. Application Data

(63) Continuation-in-part of application No. 12/333,613, filed on Dec. 12, 2008, now abandoned.

(51) Int. Cl.
*F03B 1/04* (2006.01)

(52) U.S. Cl.
USPC ..... 415/1; 415/189; 415/209.2; 415/213.1

(58) Field of Classification Search
USPC ..... 415/209.3, 209.4, 1, 209.2; 416/204 A; 29/889.22
See application file for complete search history.

(56) References Cited

U.S. PATENT DOCUMENTS

| | | | | |
|---|---|---|---|---|
| 2,801,822 | A * | 8/1957 | Speed | 415/209.3 |
| 4,815,940 | A | 3/1989 | LeShane et al. | |
| 5,118,253 | A * | 6/1992 | Balkcum, III | 415/209.2 |
| 5,127,797 | A * | 7/1992 | Carman | 415/209.2 |
| 5,131,811 | A * | 7/1992 | Johnson | 415/209.2 |
| 5,224,824 | A * | 7/1993 | Eng | 415/209.2 |
| 5,354,174 | A * | 10/1994 | Balkcum et al. | 415/209.2 |
| 5,732,547 | A | 3/1998 | Olsen et al. | |
| 5,927,130 | A | 7/1999 | Watson et al. | |
| 6,420,509 | B1 | 7/2002 | Putnam et al. | |
| 6,554,564 | B1 | 4/2003 | Lord | |
| 6,619,917 | B2 | 9/2003 | Glover et al. | |
| 6,910,860 | B2 | 6/2005 | Glover et al. | |
| 7,334,998 | B2 | 2/2008 | Jones et al. | |
| 7,354,241 | B2 * | 4/2008 | Djeridane et al. | 415/115 |
| 7,614,848 | B2 | 11/2009 | Bogue et al. | |
| 8,142,152 | B2 * | 3/2012 | Drelon et al. | 415/220 |
| 2002/0127101 | A1 * | 9/2002 | Bekrenev | 415/232 |
| 2007/0122274 | A1 * | 5/2007 | Moorman et al. | 415/209.3 |
| 2009/0041580 | A1 * | 2/2009 | Wichmann et al. | 415/209.3 |
| 2009/0097967 | A1 | 4/2009 | Smith et al. | |
| 2010/0196149 | A1 | 8/2010 | Beaulieu | |

OTHER PUBLICATIONS

US Office Action for U.S. Appl. No. 12/333,613, dated Sep. 20, 2011.

* cited by examiner

*Primary Examiner* — Edward Look
*Assistant Examiner* — Aaron R Eastman
(74) *Attorney, Agent, or Firm* — Bachman & LaPointe, P.C.

(57) ABSTRACT

A method for preventing cracking of a turbine engine case includes the steps of disposing at least two rails upon an exterior surface of a turbine engine case; and securing a first rail to a first means for attaching at least one fan exit guide vane to the turbine engine case and securing a second rail to a second means for attaching the at least one fan exit guide vane to the turbine engine case.

15 Claims, 2 Drawing Sheets

APPARATUS AND METHOD FOR PREVENTING CRACKING OF TURBINE ENGINE CASES

CROSS-REFERENCE TO RELATED APPLICATION

This is a Continuation-In-Part of Ser. No. 12/333,613, filed Dec. 12, 2008, and entitled APPARATUS AND METHOD FOR PREVENTING CRACKING OF TURBINE ENGINE CASES, the disclosure of which is incorporated by reference herein in its entirety as if set forth at length.

FIELD OF THE DISCLOSURE

The disclosure relates to turbine engines cases and, more particularly, relates to an apparatus and method for preventing cracking of turbine engine cases.

BACKGROUND OF THE DISCLOSURE

Stationary airfoils disposed aft of a rotor section within a gas turbine engine help direct the gas displaced by the rotor section in a direction chosen to optimize the work done by the rotor section. These airfoils, commonly referred to as "guide vanes", are radially disposed between an inner casing and an outer casing, spaced around the circumference of the rotor section. Typically, guide vanes are fabricated from conventional aluminum as solid airfoils. The solid cross-section provides the guide vane with the stiffness required to accommodate the loading caused by the impinging gas and the ability to withstand an impact from a foreign object.

"Gas path loading" is a term of art used to describe the forces applied to the airfoils by the gas flow impinging on the guide vanes. The magnitudes and the frequencies of the loading forces vary depending upon the application and the thrust produced by the engine. If the frequencies of the forces coincide with one or more natural frequencies of the guide vane (i.e., a frequency of a bending mode of deformation and/or a frequency of a torsional mode of deformation), the forces could excite the guide vane into an undesirable vibratory response. The guide vanes are secured between the inner and outer cases of a turbine engine case by a series of bolts.

Historically, the undesirable vibratory response at times excites the guide vane so much that the guide vane pulls the bolts through the outer case and cracks the case. As a result, the aircraft must be taken out of service in order to repair and/or replace the case and other necessary components.

Therefore, there exists a need to secure the guide vane to the outer case in order to prevent cracking or mitigate existing cracking or cracks.

SUMMARY OF THE DISCLOSURE

In accordance with one aspect of the present disclosure, a method for preventing cracking of a turbine engine case broadly comprises disposing at least two rails upon an exterior surface of a turbine engine case; and securing a first rail to a first means for attaching at least one fan exit guide vane to the turbine engine case and securing a second rail to a second means for attaching the at least one fan exit guide vane to the turbine engine case.

In accordance with another aspect of the present disclosure, a method for remanufacturing a turbine engine broadly comprises replacing at least one means for attaching at least one fan exit guide vane to a turbine engine case with at least one rail; and securing a first rail to a first means for attaching the at least one fan exit guide vane to the turbine engine case and securing a second rail to a second means for attaching the at least one fan exit guide vane to the turbine engine case.

In accordance with yet another aspect of the present disclosure, a turbine engine broadly comprises a fan section; a low pressure compressor; an engine case disposed about the fan section and the low pressure compressor; and, wherein the engine case comprises at least one rail disposed upon an exterior surface and in connection with a first means for attaching a fan exit guide vane to the engine case for reinforcing the engine case.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
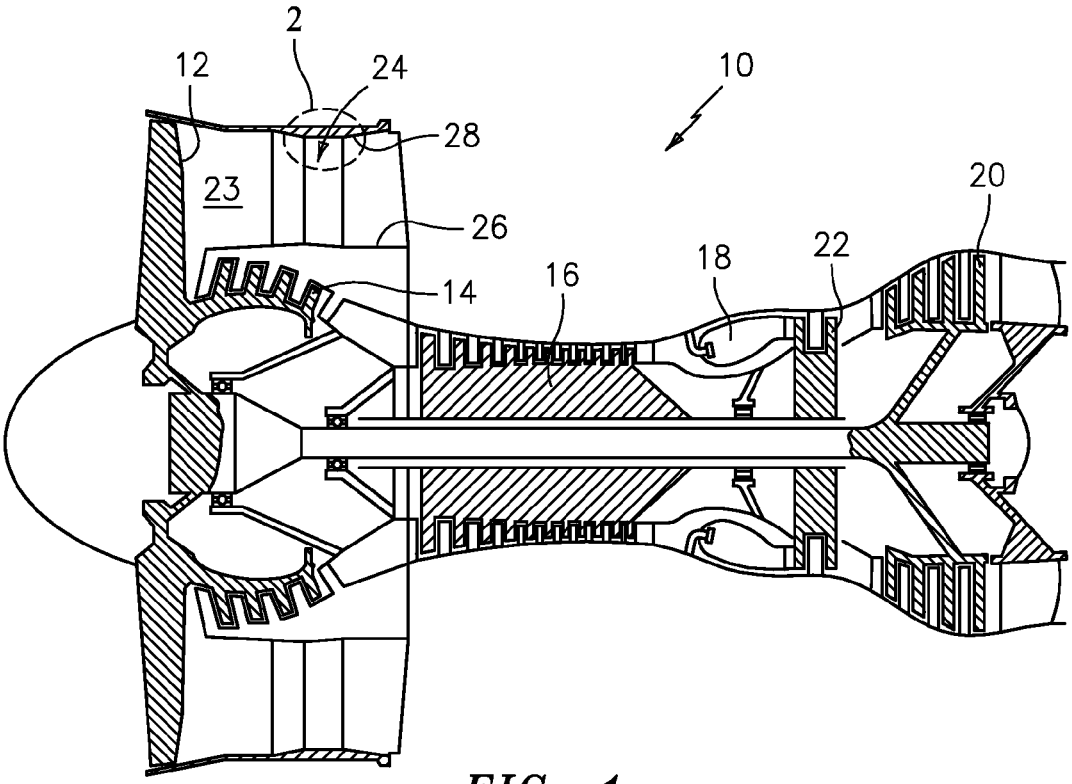
FIG. 1 Prior Art
FIG. 1 is a simplified representation of a cross-sectional view of a turbine engine.

Referring to FIG. 1, a gas turbine engine 10 includes a fan section 12, a low pressure compressor 14, a high pressure compressor 16, a combustor 18, a low pressure turbine 20, and a high pressure turbine 22. The fan section 12 and the low pressure compressor 14 are directly connected to one another and are driven by the low pressure turbine 20. In some configurations, the fan section 12 is driven separately through a gearbox at a lower speed than the low pressure turbine 20. The high pressure compressor 16 is directly driven by the high pressure turbine 22. Air compressed by the fan section 12 will either enter the low pressure compressor 14 as "core gas flow" or will enter a bypass passage 23 outside the engine core as "bypass air". Bypass air exiting the fan section 12 travels toward and impinges against a plurality of fan exit guide vanes 24, or "FEGV's", disposed about the circumference of the engine 10. The FEGV's 24 straighten and guide the bypass air into ducting (not shown) disposed outside the engine 10.

Figure 2:
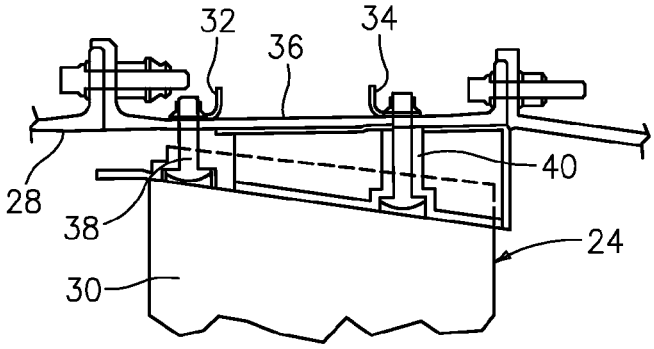
FIG. 2 is a partial representation of a fan exit guide vane and attachment of the present disclosure.
Figure 3:
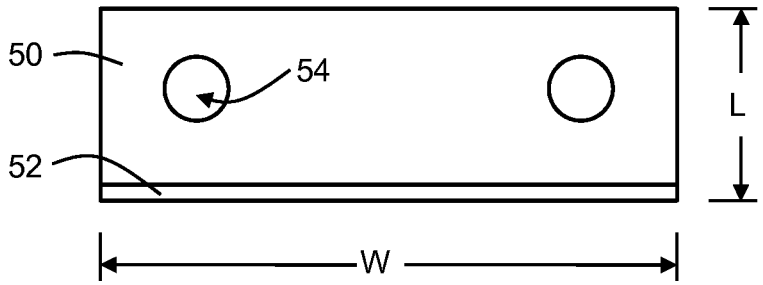
FIG. 3 is a simplified outer diameter (OD) view of a rail of the attachment of FIG. 2.
Figure 4:
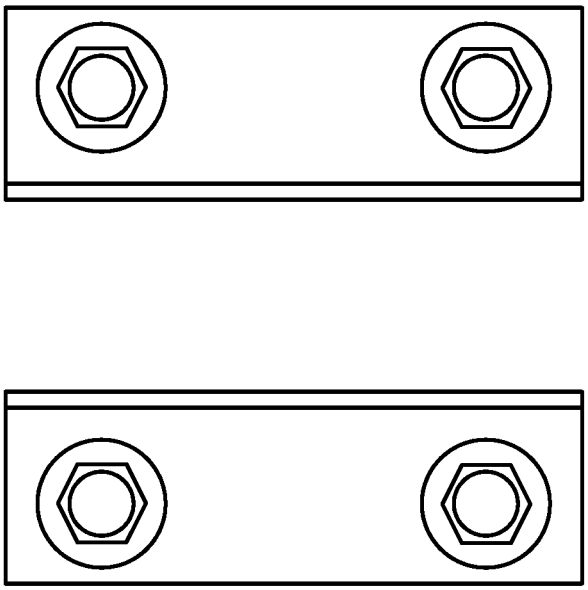
FIG. 4 is a simplified outer diameter (OD) view of the attachment of FIG. 2.

Now referring to FIGS. 1 and 2, the FEGV's 24 extend between fan inner case 26 and outer case 28. The inner case 26 is disposed radially between the low pressure compressor 14 and the FEGV's 24 and the outer case 28 is disposed radially outside of the FEGV's 24. Each FEGV 24 includes an airfoil 30 and means for attaching the airfoil 30 between the inner and outer cases 26, 28.

Referring specifically now to FIG. 2, each FEGV 24 may be attached to the outer case 26 by at least one rail, for example, a first rail 32 and a second rail 34, disposed about an exterior surface 36 of the outer case 28. The rail is elongated in a circumferential direction. The first rail 32 and second rail 34 may be aligned approximately parallel to one another and secured to the outer case 28 by a first means for attaching 38 and a second means for attaching 40, respectively. Each means for attaching 38, 40 secure each FEGV 24 to the outer case 28 and also secure each rail 32, 34 to the outer case 28.

The means for attaching 38, 40 may include at least one of the following: bolts, rivets, screws, and the like, as known to one of ordinary skill in the art. There may be at least two circumferentially spaced apart means (e.g., nut, washer, and screw/bolt combinations) for attaching 38,40 for each rail 32,34 (e.g., a front pair and a rear pair).

The rails 32, 34 may be installed where each FEGV 24 is mounted. Each rail may be circumferentially-shaped, or at least substantially circumferentially-shaped, to complement the shape of the exterior surface of the outer case 28. As can be seen, each rail 32,34 has an L-shaped cross section with a first portion 50 which extends along the case 28 (and has holes 54 for accommodating the associated means for attaching) and a second portion 52 protruding radially outward. This second portion forms a stiffening flange for the rail 32,34.

The rails 32, 34 may distribute the load experienced by the FEGV during operation and help support the outer case 28. As the FEGV vibrates, the rails 32, 34 may prevent the FEGV 24 from pulling the means for attaching through the outer case 28 as well as also prevent the case from cracking. A typical gas turbine engine contains approximately eighty (80) FEGV's, and thus approximately one hundred sixty (160) rails may be installed to stiffen the outer case and either mitigate existing cracking or cracks and/or prevent cracking from occurring. By stiffening the outer case, the entire turbine engine casing may be reinforced to withstand torsional modes of vibration experienced during operation of the turbine engine.

A pair of rails each having the following dimensions axial length L of 0.5 inches (12.7 millimeters)×radial height of 0.5 inches (12.7 millimeters)×width or length along the case circumference W of 3.0 inches (76.2 millimeters) and composed of 0.0625 inches (1.5875 millimeters) thick sheet metal (e.g., stainless steel) were bolted to a piece of an outer case and an FEGV. The structure was mounted to a hydraulic cylinder and a simulated air load was applied. One cycle constituted one stroke actuated by the hydraulic cylinder upon the structure. After subjecting the structure to ten-thousand (10,000) cycles, no crack growth was observed in the outer case and the outer case maintained an overall stiffness of between approximately eighty percent (80%) to approximately one hundred percent (100%) of the original stiffness. Exemplary ranges for axial height and length are each 10-30 mm, more narrowly 12-20 mm and for end-to-end width W 2.5-10 cm, more narrowly 6-9 cm.

One or more embodiments of the present disclosure have been described. Nevertheless, it will be understood that various modifications may be made without departing from the spirit and scope of the disclosure. Accordingly, other embodiments are within the scope of the following claims.

What is claimed is:

1. A method for preventing cracking of a turbine engine case, the method comprising:

disposing at least two rails upon an exterior surface of a turbine engine case; and securing a first said rail to a first means for attaching at least one fan exit guide vane to said turbine engine case and securing a said second rail to a second means for attaching said at least one fan exit guide vane to said turbine engine case.

2. The method of claim 1, wherein the disposing comprises:

placing said first rail in connection with said first means for attaching;

placing said second rail in connection with said second means for attaching; and aligning said first rail approximately parallel to said second rail.

3. The method of claim 1, wherein the disposing further comprises disposing at least two circumferentially-shaped rails.

4. The method of claim 1, wherein:

the at least one fan exit guide vane comprises a plurality of fan exit guide vanes and wherein the at least two rails comprises a plurality of said first rails and a plurality of said second rails; and the securing comprises securing respective said first rails to the first attaching means of respective said fan exit guide vanes and respective said second rails to the second attaching means of respective fan exit guide vanes.

5. The method of claim 1, wherein each said rail is formed of sheet metal and has an L-shaped cross-section with a first portion along the case and a second portion protruding radially.

6. A method for remanufacturing a turbine engine, the method comprising:

replacing at least one means for attaching at least one fan exit guide vane to a turbine engine case with at least one rail; and securing a first rail to a first means for attaching said at least one fan exit guide vane to said turbine engine case and securing a second rail to a second means for attaching said at least one fan exit guide vane to said turbine engine case.

7. The method of claim 6, further comprising:

aligning said first rail parallel to said second rail.

8. A turbine engine, comprising:

a fan section;

a low pressure compressor; and an engine case disposed about said fan section and said low pressure compressor, wherein said engine case comprises at least one rail disposed upon an exterior surface and in connection with a first means for attaching a fan exit guide vane to said engine case for reinforcing said engine case.

9. The turbine engine of claim 8, wherein said at least one rail further comprises a first rail connected to said exterior surface and said first means for attaching, and a second rail connected to said exterior surface and a second means for attaching.

10. The turbine engine of claim 8, wherein said at least one rail further comprises at least one circumferentially-shaped rail.

11. The turbine engine of claim 10, wherein said at least one circumferentially-shaped rail comprises a substantially circumferential shape that is complementary to said exterior surface of said engine case.

12. The turbine engine of claim 8, wherein said at least one rail has an L-shaped cross-section having a first portion along the case and a second portion protruding radially outward.

13. The turbine engine of claim 8, wherein said rail comprises a radially protruding stiffening flange.

14. The turbine engine of claim 13, wherein said at least one rail comprises a plurality of second rails each respectively connected to a second means for attaching of the associated fan exit guide vane.

15. The turbine of claim 8, wherein each rail is attached to said engine case and/or the fan exit guide vane by at least two circumferentially spaced attachment means.

* * * * *